United States Patent [19]

Glenn

[11] Patent Number: 4,511,204

[45] Date of Patent: Apr. 16, 1985

[54] RIGHT-ANGLE ELECTRICAL CLAMPING CONNECTOR

[75] Inventor: Robert L. Glenn, Arab, Ala.

[73] Assignee: Eaton Corporation, Cleveland, Ohio

[21] Appl. No.: 462,481

[22] Filed: Jan. 31, 1983

[51] Int. Cl.[3] ..... H01R 4/30

[52] U.S. Cl. ..... 339/263 R; 339/268 S; 339/270 R

[58] Field of Search ..... 339/236, 270 R, 273 R, 339/273 S, 266, 267, 274

[56] References Cited

U.S. PATENT DOCUMENTS

| | | | |
|---|---|---|---|
| 1,971,623 | 8/1934 | Rowe | 339/270 |
| 2,086,090 | 7/1937 | Ohlson | 339/270 |
| 2,097,470 | 11/1937 | Richardson | 339/270 |
| 3,812,453 | 5/1974 | Kiessling | 339/266 R |
| 3,891,297 | 6/1975 | Poliak et al. | 339/270 R |
| 4,077,696 | 3/1978 | Glaesel | 339/266 R |
| 4,175,822 | 11/1979 | Debaigt | 339/266 R |

FOREIGN PATENT DOCUMENTS

| | | | |
|---|---|---|---|
| 216077 | 7/1961 | Austria | 339/270 R |
| 615700 | 7/1935 | Fed. Rep. of Germany | 339/270 R |
| 544021 | 5/1956 | Italy | 339/270 R |

*Primary Examiner*—Gil Weidenfeld
*Assistant Examiner*—David L. Pirlot
*Attorney, Agent, or Firm*—C. H. Grace; L. G. Vande Zande

[57] ABSTRACT

A screw (14) axially abuts an oblique surface (10*a*) of a clamping member (10) to drive that member at a right angle to the axis of the screw (14) to clamp a conductor (6) against a conductive terminal member (4*a*) within an electrical switching device. A coiled band spring (12) has the coiled ends received within recesses (10*a*) in the opposite surfaces of a clamping member (10) and the central portion of the band spring looped around a supporting member (8) for the screw (14) to bias the oblique surface (10*a*) into engagement with the end of the screw (14). The band spring (12) is received within shallow grooves (8*b* and 10*b*) in the supporting and clamping members to cooperate with the grooves in restricting movement of the clamping member (10) to linear movement at right angles to the axis of screw (14). The restrictive and guiding functions of the band spring and grooves can be supplemented or substituted for by the configuration of a surrounding housing for the connector members.

12 Claims, 3 Drawing Figures

Fig. 1
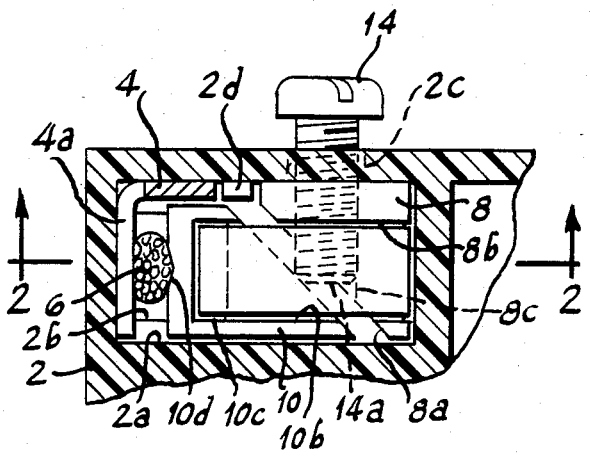
Fig. 2
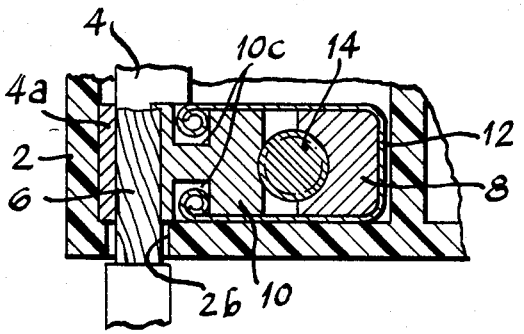
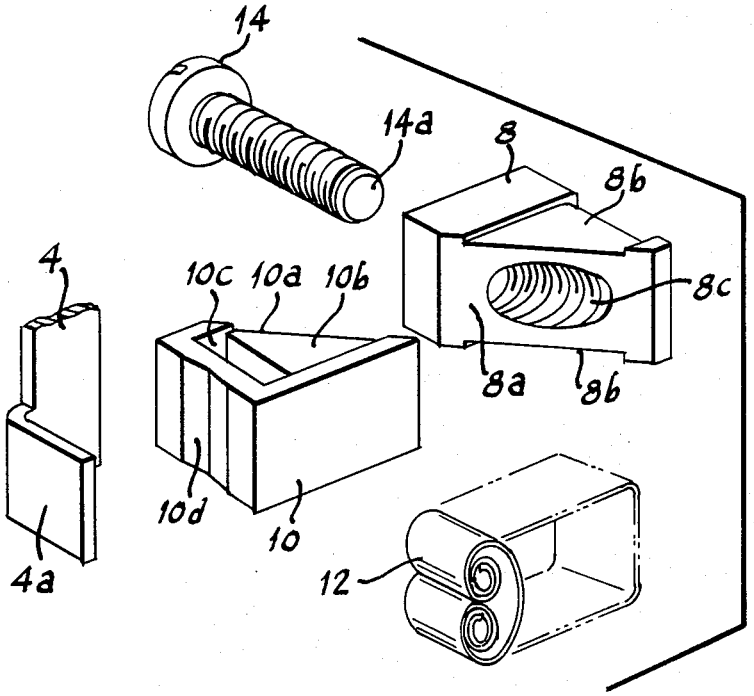
Fig. 3

RIGHT-ANGLE ELECTRICAL CLAMPING CONNECTOR

BACKGROUND OF THE INVENTION

This invention relates to electrical clamping connectors. More specifically, the invention relates to such connectors wherein the clamping member is driven by a screw and the clamping pressure is applied at right angles to the axis of the screw.

Electrical devices, such as electrical switches, are generally provided with a wide variety of wiring terminal structures to accommodate different application requirements. These terminals may comprise wire wrap posts wherein a conductor is wound around and soldered to an essentially square post projecting from the switch base, screw type terminals wherein a conductor is trapped between the head of a screw and the flat surface of a blade terminal, spade terminals consisting of a flat male blade projecting from the switch for receiving a push-on female connector affixed to the wire conductor, press-in connections wherein a bared end of a wire conductor is inserted into a hole in the switch housing to deflect a resilient tab which locks the conductor firmly into engagement with an internal terminal member of the switch, and pressure clamping connectors, sometimes referred to as pillar terminals, which receive the bared end of the wire conductor in a hole in a conductive member and clamp the conductor therein by a screw which intersects the hole and forces the conductor end firmly into engagement with a surface of the terminal member within the hole. Occasionally a switch designed to provide for one type of termination cannot readily be adapted to accept a different type of termination. With respect to the pressure clamping type connector as aforedescribed, the common type has the end of the screw bearing axially against the side of the bared end of the conductor, but some switch designs prohibit location of the screw such that its axis will intersect the conductor, or the space available for such connector is severely restricted. Connectors are known which are designed for special applications wherein the axis of the screw and the conductor do not intersect, these connectors generally employing a lever system upon which the screw operates to pivot a clamping member into clamping engagement with a conductive member connected to the switch. While these designs are effective for their intended applications, this invention relates to an improvement thereover.

SUMMARY OF THE INVENTION

This invention provides an electrical connector wherein the end of a screw bears upon an oblique surface on a clamping member to drive that member linearly at right angles to the axis of the screw to clamp a wire conductor against an electrically conductive terminal element. The screw is supported in a first member of the connector to have its end project beyond the support member to bear against the oblique surface of the clamping member. An extendable band provides resilient bias between the two members, urging the oblique surface of the clamping member against the end of the screw, and maihtains the two members assemled together in a manner that constrains movement of the clamping member to linear travel at right angles to the screw axis. The constraint and guidance functions of the extendable band may be substituted for or supplemented by the configuration of the electrical device housing structure which receives the connector of this invention.

BRIEF DESCRIPTION OF THE DRAWINGS

FIG. 1 is a fragmentary sectional view of an electrical device insulating housing showing the electrical connector of this invention in top plan view;

FIG. 2 is a cross-sectional view taken along line 2—2 of FIG. 1; and FIG. 3 is an exploded isometric view of the electrical connector of this invention.

DESCRIPTION OF THE PREFERRED EMBODIMENT

With reference to FIG. 1 of the drawings, a fragmentary section of an insulating housing 2 of an electrical device such as a switch or the like is shown as being viewed from the top or switch side. The portion of the housing shown has an essentially rectangular pocket 2*a* formed therein which has a first opening 2*b* in the bottom wall of the pocket communicating between the pocket and the exterior of the insulating housing. A second opening 2*c* is provided in a sidewall of the housing 2 and also communicates between the pocket and the exterior of the housing. An electrically conductive terminal member 4 extends down from the switch into the pocket 2*a* along the sidewall of the housing 2. The terminal 4 may preferably be a depending projection from a stationary contact of the switch, and its location within the switch housing is therefore determined by switch operation and contact design. A projection 2*d* on the sidewall of housing 2 and the endwall of the housing 2 and pocket 2*a* position the terminal 4 laterally along the internal sidewall of the pocket 2*a*. Thus the location of terminal 4 prevents the use of a pillar type pressure connector for clamping a wire conductor 6 inserted through the opening 2*b* with side access to the clamping screw.

The connector of this invention provides side access for the clamping screw and directs the clamping force at right angles to the access of the screw. The connector is most clearly shown in FIG. 3 and can be seen to comprise a first support member 8, a clamping member 10, a coiled band spring 12 and a screw 14. Support member 8 and clamping member 10 have complementally formed, mutually engagable oblique surfaces 8*a* and 10*a*, respectively, which are preferably formed at a 45 degree angle. These members are also provided with a shallow lateral, or external, groove 8*b* and 10*b*, respectively. Clamping member 10 has a pair of rectangular recesses 10*c* formed on respective opposite sides thereof and which communicate with the respective grooves 10*b*. Support member 8 has a threaded hole 8*c* extending from the side thereof adjacent the sidewall of the housing 2 and through the oblique surface 8*a*. The members 8 and 10 are assembled together with their oblique surfaces 8*a* and 10*a* in mutual engagement by placing the central portion of coiled band spring 12 around the support member 8 within the groove 8*b* and uncoiling the respective ends of spring 12 along the grooves 8*b* and 10*b* until the remaining coiled end portions are received within the rectangular recesses 10*c*. The cooperation of spring 12 within the grooves 8*b* and 10*b* and the recesses 10*c* serves to secure the members 8 and 10 together and restricts movement of clamping member 10 to linear movement at right angles to the axis of the threaded hole 8*c*. The connector as thus assembled may be inserted into the pocket 2a from the top such that the opening 8c aligns with the opening 2c in the sidewall of housing 2. Referring again to FIG. 1, it may be seen that the projection 2d also serves to position the support member 8 laterally within the pocket 2a. The screw 14 is inserted through the opening 2c to threadably take into the opening 8c. The internal end 14a of screw 14 is preferably provided with a chamfer of the same angle as the oblique surface 10a. Clockwise rotation of the screw 14 produces inward axial movement thereof whereby the inner end 14a projects beyond the surface 8a of support member 8 and engages the oblique surface 10a of clamping member 10, thereby driving the clamping member 10 linearly to the left as viewed in FIG. 1 at right angles to the axis of screw 14. The left-hand end of clamping member 10 may be seen to have a shallow V-shaped groove 10d therein for centering the bared end of conductor 6 with respect to the clamping member 10. The terminal 4 is provided with an offset extension 4a which is positioned along an interior endwall of pocket 2a in proximity to the opening 2b. Continued clockwise rotation of screw 14 causes the clamping member 10 to clamp the conductor 6 against the extension 4a of terminal 4. The coiled ends of band spring 12 uncoil within the recesses 10c as the clamping member is driven linearly to the left as viewed in the drawings. Upon counterclockwise rotation of screw 14 to release the conductor 6, the coiled ends of band spring 12 will recoil within the recesses 10c to permit the clamping member 10 to follow the retracting inner end of screw 14 and thereby releasing the conductor 6.

The constraint and guiding of clamping member 10 to linear movement may be provided also by the structural configuration and tolerances of the pocket 2a and may be provided in lieu of or supplemental to the restrictions provided by the band spring 12. Where such functions are provided solely by the pocket 2a, the biasing function may be provided by other spring forms such as a helically wound torsion spring positioned at the inside angle juncture of the oblique surfaces 8a and 10a and having hooked legs engaging holes at opposite sides of the respective members 8 and 10. The biasing function may also be provided by a leaf spring fixed with respect to the support member 8 and deflectible by a formation or slot in the movable clamping member 10. The right-angle electrical clamping connector having a clamping screw axially bearing directly upon an oblique surface of the clamping member to directly translate axial movement of the screw to right-angle clamping movement has been disclosed in a preferred embodiment and suggested modifications herein, and it is to be understood that it is susceptible of various other modifications without departing from the scope of the appended claims.

I claim:

1. An electrical connector comprising in combination:

means supporting a screw for axial movement in response to rotation thereof, an end of said screw projecting beyond said supporting means;

electrical terminal means fixedly positioned in laterally spaced relation to said screw;

a clamping member disposed adjacent said projecting end of said screw for linear sliding movement at right angles to the axis of said screw, said clamping member having an oblique surface abuttingly engaged by said projecting end of said screw whereby axial movement of said screw drives said clamping member laterally away from the axis of said screw toward said terminal means for clamping an electrical conductor therebetween; and spring means biasing said clamping member oblique surface into engagement with said projecting end of said screw.

2. The invention defined in claim 1 wherein said spring means links said clamping means and said supporting means.

3. The invention defined in claim 2 wherein said spring means retains said clamping member slidably disposed adjacent said projecting end of said screw.

4. The invention defined in claim 3 wherein said spring means comprises a coiled band extendable under tension when said clamping member is driven toward said electrical terminal means.

5. The invention defined in claim 4 wherein opposite ends of said band spring are coiled inwardly toward a central portion of said band and said clamping member has recesses in opposite sides thereof for respectively receiving said coiled opposite ends therein, the central portion of said band being disposed around said support means.

6. The invention defined in claim 5 wherein said support means and said clamping means are provided with grooves, said band spring being received in said grooves for restricting movement of said clamping members to sliding movement perpendicular to the axis of said screw.

7. The invention defined in claim 1 wherein said support means has an oblique surface formed complemental to said oblique surface on said clamping means, said oblique surfaces being in mating engagement when said screw is axially withdrawn within said support means.

8. A pressure connector terminal for an electrical device comprising, in combination:

an insulating housing for said device, said housing having a pocket therein and first and second external openings communicating with said pocket;

conductive means mounted at one end of said pocket in proximity to said first opening, said conductive means being electrically connected to said device;

clamping means disposed within said pocket and restrained by said pocket for linear sliding movement toward and away from said conductive means, said clamping means having an oblique surface;

support means having a threaded hole therethrough entrapped within an opposite end of said pocket wherein said threaded hole is aligned with said second opening and axially perpendicular to the direction of movement of said clamping means;

a screw received in said threaded opening and having an internal end projecting beyond said support means for abutting engagement with said oblique surface, wherein rotation of said screw for inward axial movement slides said clamping means toward said conductive means to clamp a conductor inserted through said first opening between said conductive means and said clamping means; and spring means biasing said clamping means oblique surface into engagement with said projecting end of said screw.

9. The invention defined in claim 8 wherein said support means has an oblique surface complementally formed to said oblique surface on said clamping means, said oblique surfaces being biased into mutual engagement when said projecting end of said screw is withdrawn into said support means.

10. The invention defined in claim 9 wherein said spring means comprises an extendable band.

11. The invention defined in claim 10 wherein said spring means comprises a coiled band, the outer ends of said band being coiled toward a central portion thereof and each received in recesses on respective sides of said clamping means and the central portion of said band passing around said support means.

12. The invention defined in claim 11 wherein said clamping means and said support means have grooves for receiving said band therein for coupling said clamping and support means and restricting said clamping member to sliding movement radially of said screw axis.

* * * * *